US005285174A

United States Patent [19]

Al-Bundak et al.

[11] Patent Number: 5,285,174

[45] Date of Patent: Feb. 8, 1994

[54] TEMPERATURE-COMPENSATED WAVEGUIDE ISOLATOR

[75] Inventors: Omar M. Al-Bundak, Los Angeles; Antonio Luna, Pomona, both of Calif.

[73] Assignee: Hughes Aircraft Company, Los Angeles, Calif.

[21] Appl. No.: 996,206

[22] Filed: Dec. 23, 1992

[51] Int. Cl.[5] ..... H01P 1/39

[52] U.S. Cl. ..... 333/1.1; 333/24.2

[58] Field of Search ..... 333/1.1, 24.1, 24.2

[56] References Cited

U.S. PATENT DOCUMENTS

| | | | |
|---|---|---|---|
| 3,246,262 | 4/1966 | Wichert | 333/24.1 X |
| 4,808,949 | 2/1989 | Forterre | 333/1.1 |
| 5,157,360 | 10/1992 | McGann et al. | 333/24.2 X |

*Primary Examiner*—Paul Gensler

*Attorney, Agent, or Firm*—William J. Streeter; Wanda K. Denson-Low

[57] ABSTRACT

A temperature-compensated junction isolator (28) is used with a waveguide junction (20) in a hollow microwave waveguide system (22). The junction isolator (28) includes a ferrite cylinder (34) within the waveguide walls (30 and 32) at the junction with its cylinder axis (36) perpendicular to the waveguide walls (30 and 32). A pair of temperature-compensation washers (38) are aligned with the cylinder axis (36) of the ferrite cylinder (34) and are positioned external to the waveguide walls (30 and 32). Each washer (38) has a central opening (40) smaller in diameter than the diameter of the ferrite cylinder (34) and is made of a material whose permeability decreases with increasing temperature, preferably a nickel-iron alloy with about 30 percent iron. A pair of magnets (42) are aligned with the cylinder axis (36) of the ferrite cylinder (34), one of the magnets (42) being located exterior to each of the temperature-compensation washers (38). The waveguide junction isolator (28) produces a circulator function with relatively uniform properties over a range of operating temperatures.

18 Claims, 2 Drawing Sheets

TEMPERATURE-COMPENSATED WAVEGUIDE ISOLATOR

BACKGROUND OF THE INVENTION

This invention relates to microwave devices, and, more particularly, to a design for a waveguide junction isolator that achieves relatively unvarying performance over a range of temperatures.

Microwaves (including millimeter waves) are high frequency waves in the gigahertz range that are widely used in communications and other applications due to their ability to carry a large amount of information. Microwaves can propagate either in a waveguide or through free space. The present invention relates to their propagation in a waveguide.

In a microwave waveguide system, there are sometimes junctions between several lengths of waveguide. In one type of commonly encountered junction, the Y-junction, three ports leading to separate waveguides lie in a plane and are oriented symmetrically from a central junction structure. In the absence of an isolator, microwaves entering the junction from one port propagate to the other two ports with diminished energy.

In many applications, however, it is desirable to be able to direct the microwave energy from one port entirely to another port, isolating the third port so that very little of the microwave energy flows to it. A microwave isolator is a known device that may be placed at the junction to perform the function of directing the microwave energy from one port to another port, while isolating a third port.

A microwave isolator of conventional design for use with a hollow microwave waveguide includes a ferrite cylinder within the waveguide walls at the center of the junction structure. Outside the waveguide walls on either side of the ferrite cylinder and aligned with its cylindrical axis are permanent magnets that produce a magnetic field through the ferrite cylinder. The design and operation of conventional microwave junction isolators are known in the art. The operation of the microwave junction isolator is determined by factors such as the wavelength of the microwave radiation, the physical size of the waveguide, the physical size of the ferrite cylinder and the magnet, the strength of the magnet, and the geometry of the isolator structure.

Microwave junction isolators must operate over a range of temperatures, both because the environment of the waveguide system may change and because the transmitted microwave energy heats the waveguides and other parts of the system. It is highly desirable that the isolator have properties that are relatively independent of temperature, and therefore various design modifications of the basic junction isolator have been developed with the objective of achieving a temperature-independent operation. These prior temperature-compensated designs have not been fully satisfactory, and do not achieve as temperature-independent an operation as desired.

There is therefore a need for an improved temperature-compensation approach for waveguide isolators. Such an approach should be operable with known types of waveguide junctions, and should achieve the isolation or circulation function with minimal temperature dependence of performance. The present invention fulfills this need, and further provides related advantages.

SUMMARY OF THE INVENTION

The present invention provides a temperature-compensated junction isolator for use in microwave junctions such as three-port Y-junctions. The junction isolator of the invention utilizes available materials in a novel arrangement. It achieves improved temperature compensation as compared with prior temperature-compensated junction isolator designs.

In accordance with the invention, a temperature-compensated junction isolator for use at a waveguide junction in a microwave waveguide system lying within a reference plane comprises ferrite cylinder means for producing a resonance within a waveguide junction. The ferrite cylinder means includes a ferrite cylinder with a cylinder axis perpendicular to the reference plane that defines the plane of the waveguide junction. There is magnet means for producing a magnetic field in the ferrite cylinder means, the magnet means including a magnet aligned with the cylinder axis of the ferrite cylinder. Temperature compensation means for compensating for temperature-dependent changes in the properties of the ferrite means and the magnet means includes a pair of temperature-compensation washers aligned with the cylinder axis of the ferrite cylinder means on either side thereof and between the ferrite cylinder means and the magnet means. Each washer has a central opening smaller in diameter than the diameter of the ferrite cylinder and is made of a material whose permeability decreases with increasing temperature.

The temperature-compensation washers, made of a material having a permeability that decreases with increasing temperature, are a key to the present invention. The properties of the ferrite and the magnet change with temperature. To temperature compensate the junction isolator, the magnetic flux through the ferrite must increase with increasing temperature. At lower temperatures, the washer shunts the magnetic field of the magnet around the ferrite, resulting in decreased flux through the ferrite. With increasing temperature, the permeability of the material used in the washer decreases so that the shunting of the magnetic field decreases. The result is increased flux through the ferrite with increasing temperature. Providing the temperature-compensating material in washer form has been found to be particularly effective in achieving a relatively constant performance of the junction isolator with variations in temperature.

Even further temperature compensation can be achieved by placing around each magnet a compensation ring made of the same type of material as used in the washer. Specifically, the compensation ring is made of a material whose permeability decreases with increasing temperature, and may be the same or a different material as that in the washer.

The material whose permeability decreases with increasing temperature is preferably a nickel-iron alloy containing about 30 percent nickel. This material is available in sheet form commercially, and can be made into washers.

The present invention improves the performance of junction isolators. The impedance match of the waveguide system using the present junction isolator is nearly constant over a range of temperatures. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
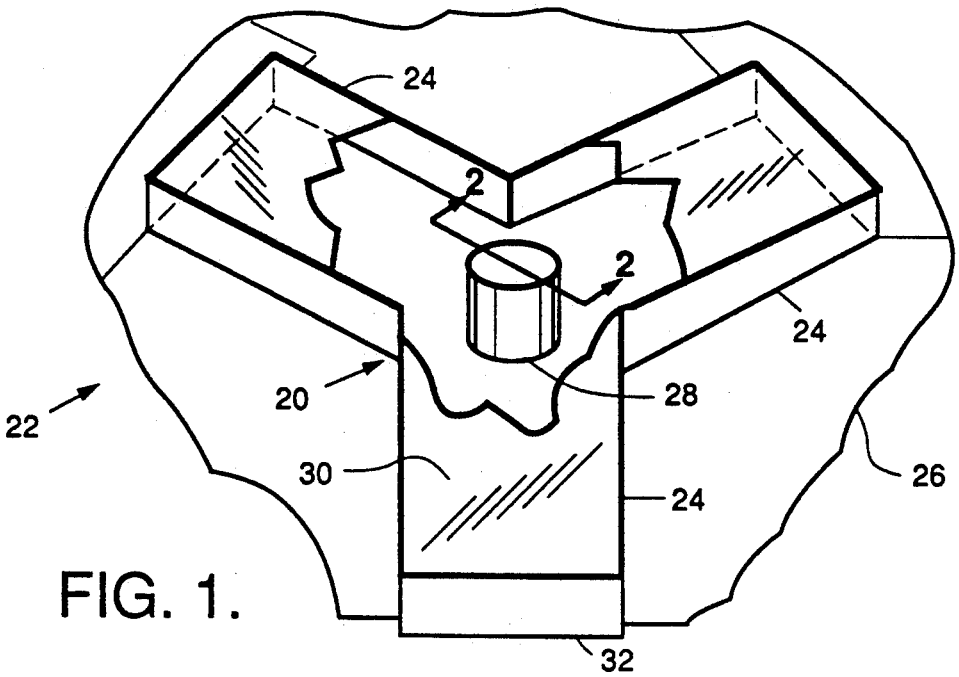
FIG. 1 is a perspective view of a junction isolator at a Y-junction in a microwave guide system, with a portion of the exterior structure broken away to show the interior of the isolator.

FIG. 1 illustrates a junction, in this case a Y-junction 20, in a microwave system 22. Three microwave waveguides 24 meet at the junction 20. The waveguides 24 lie in a plane 26, and within the plane 26 are oriented at equal angles to each other. At the Y-junction 20 is a junction isolator, in this case a Y-junction isolator 28. The function of the Y-junction isolator 28 is to controllably direct microwave energy input from one of the waveguides 24 into a single one of the other waveguides 24, while isolating the third waveguide 24 so that no energy flows into the third waveguide 24.

FIG. 1 illustrates a hollow waveguide system, each waveguide 24 having a top waveguide wall 30 and a bottom waveguide wall 32, both walls lying parallel to the plane 26. Y-junction isolators can also be used for stripline waveguide systems, and the present invention is operable in relation to both types of Y-junction isolators. The theory, functioning, and operation of the conventional Y-junction isolator for both hollow waveguides and stripline waveguides are known in the art, see for example, C. E. Fay and R. L. Comstock, "Operation of the Ferrite Junction Isolator", *IEEE Trans. Microwave Theory and Techniques*, vol. MTT-13, pages 15-27 (1965) and Y. Bosma, "On Stripline Y-Circulation at UHF", *IEEE Trans. Microwave Theory and Techniques*, vol. MTT-12, pages 61-72 (1964).

Figure 2:
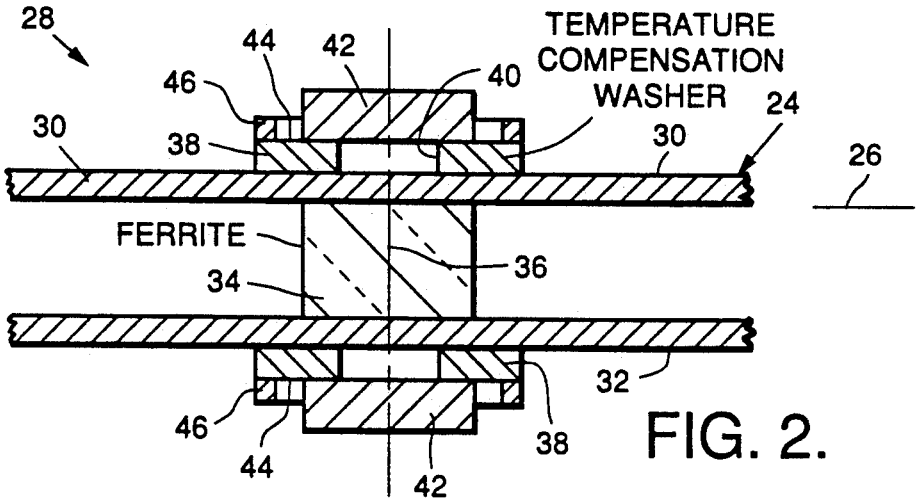
FIG. 2 is an enlarged sectional view of the Y-junction isolator of FIG. 1, taken along line 2—2.

FIG. 2 depicts the Y-junction isolator 28 in greater detail. A ferrite cylinder 34 fits between the top waveguide wall 30 and the bottom waveguide wall 32, within the interior of the Y-junction 20. The ferrite cylinder 34 has a cylinder axis 36.

Two washers 38 are aligned with the cylinder axis 36, one on either side of the ferrite cylinder 34 and exterior to the waveguide walls 30 and 32. Each washer 38 rests against the exterior of the respective waveguide wall 30 or 32. Each washer 38 is in the form of an annulus, or disk with a round central opening 40. The diameter of the central opening 40 is smaller than the diameter of the ferrite cylinder 34.

Figure 4:
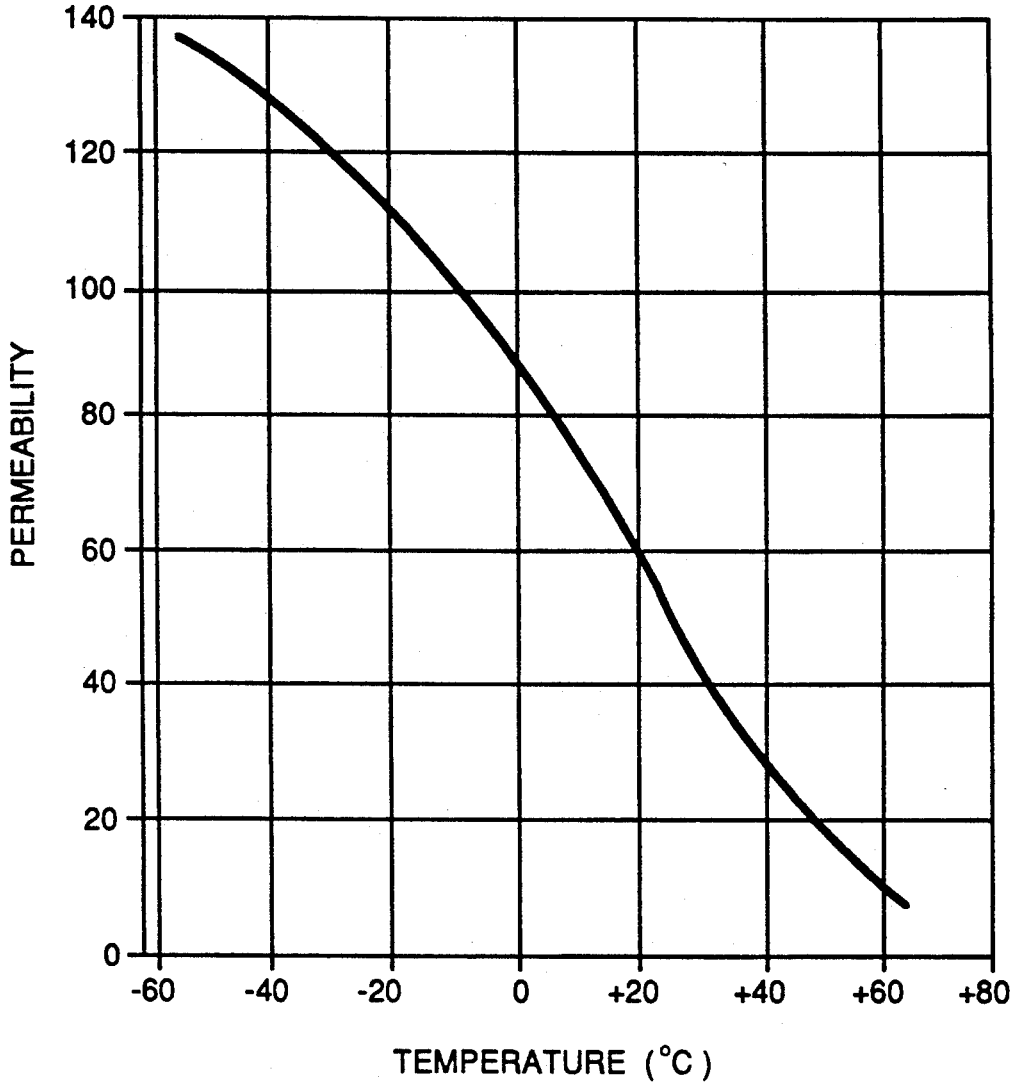
FIG. 4 is a graph of permeability of the washer material as a function of temperature.

The washers 38 are made of a material whose magnetic permeability decreases with increasing temperature. A preferred material is Carpenter Temperature Compensator "30" Type II alloy, a nickel-iron alloy having 30 percent nickel. This material has a temperature dependence of permeability as shown in FIG. 4 for an exemplary magnetization force H of 46 Oersteds. The permeability decreases with increasing temperature. This material is available commercially from Carpenter Technology in the form of sheets that can be processed into washer form, as by punching the washer from the sheet. If the washer is cold worked during forming, the temperature permeability properties are restored by heating the material to a temperature of about 982-1010C for five minutes and air cooling to ambient temperature.

Two disk magnets 42 are aligned with the cylinder axis 36, one external to each of the washers 38. Each magnet 42 rests against an exterior surface 44 of the respective washer 38. Each magnet 42 is in the form of a solid disk having a diameter greater than that of the washer central opening 40. The magnets 42 are preferably samarium cobalt permanent magnets.

Optionally, two compensation rings 46 are aligned with the cylinder axis 36, one external to each of the washers 38. Each compensation ring 46 has an inner diameter greater than an outer diameter of the disk magnets 42, and preferably has an outer diameter approximately equal to that of the washer 38. Each compensation ring 46 rests against the exterior surface 44 of the respective washer 38. Since the inner diameter of the compensation ring 46 is greater than the outer diameter of the magnet 42, the compensation ring 46 fits over and surrounds its respective magnet 42. The compensation rings 46, where used, are made of a material whose magnetic permeability decreases with increasing temperature. A preferred material is the same Carpenter Temperature Compensator "30" Type II alloy used in the washer 38. Alternatively, other materials having a decreasing permeability with temperature can be used.

The magnets 42 apply a magnetic field to the ferrite cylinder 34, producing the ferrimagnetic resonance in the ferrite cylinder 34 that is required for operation of the isolator 28. The field produced by the magnet 42 has little temperature dependence, but the ferrite cylinder 34 gradually loses its magnetization at increasing temperatures. Therefore, in the absence of temperature compensation, the input match of the isolator 28 changes with increasing temperature.

The temperature-compensation washers 38 act as shunts, which conduct some of the magnetic field lines around the ferrite cylinder 34. At low temperatures, the washers 38 have high permeability and divert a large fraction of the flux away from the ferrite cylinder 34. With increasing temperature, the permeability of the washers 38 decreases, diverting a smaller fraction of the flux away from the ferrite cylinder 34, so that a larger fraction of the magnetic field passes through the ferrite cylinder 34. The result is that the net magnetization of the ferrite cylinder 34 is a balance between the decreasing magnetization of the ferrite material with increasing temperature and an increasing fraction of the magnetic field passing through the ferrite cylinder 34 with increasing temperature. The use of the washer 38 permits this balancing to net out as a nearly constant magnetic field in the ferrite cylinder 34 as the temperature changes over a range of at least from about −50 C. to about +100 C.

To even out the net magnetic field through the ferrite cylinder 34 to a yet more constant value, it has been found that the compensation rings 46 can be added. The compensation rings 46, preferably made of the same material as the washers 38, can further fine tune the magnetic flux diversion for an even more constant magnetic field in the ferrite cylinder 34.

By way of example of the specific dimensions and construction, in a Y-junction isolator 28 for a WR75 microwave hollow waveguide Y-function 20 the diameter of the ferrite cylinder 34 and the magnet 42 was 0.375 inches. The outer diameter of the washer 38 and the compensator ring 46 was 0.625 inches. The inner diameter of the washer 38 (i.e., the diameter of the central opening 40) was 0.290 inches. The inner diameter of the compensation ring 46 was 0.500 inches. The washer 38 was 0.050 inches thick, the compensator ring 46 was 0.050 inches thick, and the magnet 42 was 0.110 inches thick. The ferrite cylinder 34 was made of standard C20 ferrite material having a Curie temperature of 560 C. The washer 38 and the compensator ring 46 were made of Carpenter Temperature Compensator "30" Type II alloy, having a relative permeability of about 160 at ambient temperature and about 0 at 160 F. The magnet 42 was a samarium cobalt permanent magnet.

Figure 3:
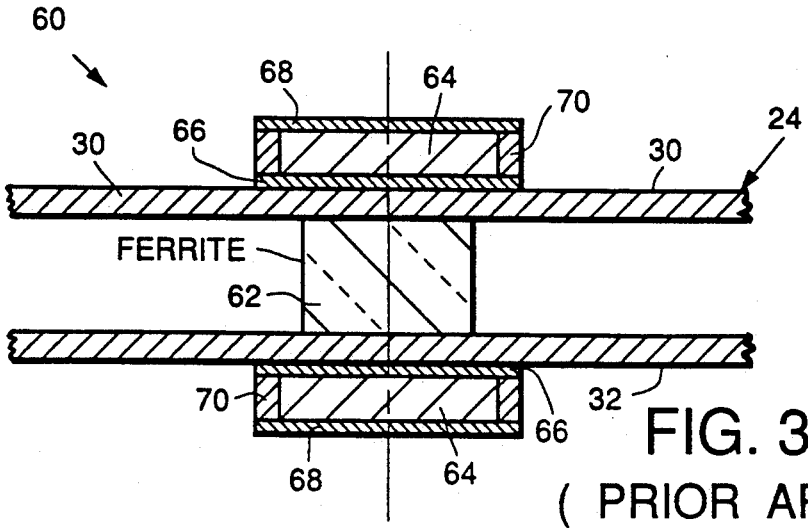
FIG. 3. ( PRIOR ART )
FIG. 3 is a side sectional view of a prior art Y-junction isolator in the same view as FIG. 2.

By way of comparison, a conventional Y-junction isolator 60 is shown in FIG. 3. The isolator 60 has a ferrite cylinder 62 within the interior of the Y-junction 20 and the waveguide walls 30 and 32. Two magnets 64 are exterior to the walls 30 and 32, one on either side of the waveguide 24. A degree of temperature compensation is achieved by placing disk 66, made of 1010 steel meeting ASTM A568, between the magnet 64 and the respective waveguide wall 30 or 32. Another 1010 steel disk 68, meeting ASTM A568, is placed external to each of the magnets 64. A ring 70 made of Carpenter Temperature Compensator "30" Type II alloy is the same height at the thickness of the magnet 64 and has an inner diameter substantially the same as the outer diameter of the magnet 64. The ring 70 thus acts mechanically as a spacer between the disks 66 and 68. In a form suitable for use in a WR75 microwave waveguide Y-junction, the ferrite cylinder has a diameter of 0.375 inches, the magnets 64 have a diameter of 0.500 inches, the rings 70 and disks 66 and 68 have an outer diameter of 0.625 inches, the disks 66 and 68 are 0.020 inches thick, and the magnet 64 and ring 70 are 0.050 inches thick.

Although a particular embodiment of the invention has been described in detail for purposes of illustration, various modifications may be made without departing from the spirit and scope of the invention. Accordingly, the invention is not to be limited except as by the appended claims.

What is claimed is:

1. A temperature-compensated junction isolator for use at a waveguide junction in a microwave waveguide system having parallel top and bottom waveguide walls, comprising:

a ferrite cylinder within the waveguide walls at a junction, the ferrite cylinder having a cylindrical axis perpendicular to the waveguide walls;

a pair of temperature-compensation washers aligned with the cylindrical axis of the ferrite cylinder and external to the waveguide walls, each washer having a central opening smaller in diameter than the diameter of the ferrite cylinder and being made of a material whose permeability decreases with increasing temperature; and a pair of magnets aligned with the cylindrical axis of the ferrite cylinder, one magnet being located exterior to each of the temperature-compensation washers.

2. The waveguide isolator of claim 1, wherein the waveguide junction is a Y-junction having three symmetrically positioned ports therein.

3. The waveguide isolator of claim 1, wherein the isolator further includes a compensation ring exterior to each of the washers and surrounding the magnets, the compensation ring being made of a material whose permeability decreases with increasing temperature.

4. The waveguide isolator of claim 1, wherein the material whose permeability decreases with increasing temperature is a nickel-iron alloy.

5. The waveguide isolator of claim 1, wherein the material whose permeability decreases with increasing temperature is a nickel-iron alloy with about 30 weight percent nickel.

6. The waveguide isolator of claim 1, wherein each magnet is a disk having a diameter greater than the diameter of the central opening of its respective washer.

7. The waveguide isolator of claim 1, wherein the ferrite has a diameter of about 0.375 inches, the washer has a diameter of about 0.625 inches, and the washer opening has a diameter of about 0.290 inches.

8. A temperature-compensated junction isolator for use at a waveguide junction in a microwave waveguide system lying within a reference plane, comprising:

ferrite cylinder means for producing a resonance within a waveguide junction, the ferrite cylinder means including a ferrite cylinder with a cylinder axis perpendicular to a reference plane that defines the plane of the waveguide junction;

magnet means for producing a magnetic field in the ferrite cylinder means, the magnet means including a magnet aligned with the cylinder axis of the ferrite cylinder; and temperature compensation means for compensating for temperature-dependent changes in the properties of the ferrite means and the magnet means, the temperature compensation means including a pair of temperature-compensation washers aligned with the cylinder axis of the ferrite cylinder means on either side thereof and between the ferrite cylinder means and the magnet means, each washer having a central opening smaller in diameter than the diameter of the ferrite cylinder and being made of a material whose permeability decreases with increasing temperature.

9. The waveguide isolator of claim 8, wherein the ferrite means includes a single ferrite cylinder.

10. The waveguide isolator of claim 9, wherein the ferrite cylinder is located within a hollow waveguide.

11. The waveguide isolator of claim 8, wherein the magnet means includes two magnets, each aligned with the cylinder axis of the ferrite means, one magnet being located on each side of the ferrite means.

12. The waveguide isolator of claim 8, wherein the temperature-compensation means includes two substantially identical washers, one on either side of the ferrite means.

13. The waveguide isolator of claim 8, wherein the waveguide junction is a Y-junction having three symmetrically positioned ports therein.

14. The waveguide isolator of claim 8, wherein the isolator further includes compensation ring means, the compensation ring means including a compensation ring exterior to one of the washer means and surrounding one of the magnet means, the compensation ring being made of a material whose permeability decreases with increasing temperature.

15. The waveguide isolator of claim 8, wherein the material whose permeability decreases with increasing temperature is a nickel-iron alloy.

16. The waveguide isolator of claim 8, wherein the material whose permeability decreases with increasing temperature is a nickel-iron alloy with about 30 weight percent nickel.

17. The waveguide isolator of claim 8, wherein the magnet is a disk having a diameter greater than the diameter of the central opening of its respective washer.

18. The waveguide isolator of claim 8, wherein the ferrite has a diameter of about 0.375 inches, the washer has a diameter of about 0.625 inches, and the washer opening has a diameter of about 0.290 inches.

* * * * *